US007555918B1

(12) United States Patent
Brown et al.

(10) Patent No.: US 7,555,918 B1
(45) Date of Patent: Jul. 7, 2009

(54) LIQUID PRODUCTION MODULATION IN SELF-REFRIGERATED CRYOGENIC NITROGEN GAS GENERATORS

(75) Inventors: Ross M. Brown, Escondido, CA (US); Irina Dean, El Segundo, CA (US)

(73) Assignee: Cosmodyne, LLC, Murrieta, CA (US)

( * ) Notice: Subject to any disclaimer, the term of this patent is extended or adjusted under 35 U.S.C. 154(b) by 396 days.

(21) Appl. No.: 11/438,974

(22) Filed: May 24, 2006

(51) Int. Cl.
*F25J 3/00* (2006.01)

(52) U.S. Cl. ..... 62/656; 62/643; 62/657

(58) Field of Classification Search ..... 62/656, 62/643, 657
See application file for complete search history.

(56) References Cited

U.S. PATENT DOCUMENTS 3,225,551 A * 12/1965 Kelley ..... 62/628
3,237,376 A * 3/1966 Bauer ..... 95/16
3,272,722 A * 9/1966 Walker ..... 203/2
3,344,040 A * 9/1967 Rijnsdorp ..... 203/1
3,697,384 A * 10/1972 Walker ..... 203/1
4,030,986 A * 6/1977 Shinskey ..... 203/2
4,377,443 A * 3/1983 Tuck et al. ..... 203/1
5,084,081 A * 1/1992 Rohde ..... 62/656
5,122,175 A * 6/1992 Koyama et al. ..... 62/651
5,505,051 A * 4/1996 Darredeau et al. ..... 62/656
6,622,521 B2 * 9/2003 Seiver et al. ..... 62/656
6,751,527 B2 * 6/2004 Herzog ..... 700/266
2006/0225462 A1 * 10/2006 Esposito et al. ..... 62/656

* cited by examiner

*Primary Examiner*—William C Doerrler
(74) *Attorney, Agent, or Firm*—William W. Haefliger

(57) ABSTRACT

The method of adding heat to refrigerated rich liquid that accumulates in a reservoir in a distillation column, to prevent the column from flooding, that includes the steps sensing a rise in rich liquid level to predetermined level in the reservoir, removing rich liquid from the reservoir in response to said sensing, to flow to vaporizer apparatus outside a cold box containing said column, adding heat to the removed rich liquid and converting the removed rich liquid into gas, in said vaporizer apparatus, returning said gas to the distillation column, and utilizing heat from the returned gas in the column to remove excess refrigeration from the rich liquid remaining in the column, thereby stabilizing the column against flooding.

19 Claims, 2 Drawing Sheets

LIQUID PRODUCTION MODULATION IN SELF-REFRIGERATED CRYOGENIC NITROGEN GAS GENERATORS

BACKGROUND OF THE INVENTION

This invention relates generally to liquid production modulation in self-refrigerated cryogenic nitrogen gas generators; and more particularly to a method of accommodating excess refrigeration during the process of liquefying and distilling air to produce pure nitrogen.

Pure nitrogen can be obtained by liquefying and distilling air. There are many thermodynamic cycles existing for accomplishing this process. Many of them use a cryogenic expansion turbine to extract work and produce refrigeration. Frequently, the turbine produces more refrigeration than required to operate the cycle. In these cases the refrigeration is used to liquefy a portion of the purified nitrogen product and store it in a tank for use as a backup in case the plant goes off-line, or to provide extra nitrogen to handle demands above the generator output, or as source of product to be transported off-site. A problem arises when the liquid nitrogen storage tank is full and the excess refrigeration cannot be removed from the generator as liquid product. To continue operations the excess refrigeration must be disposed of in a manner which does not upset the process.

There is need for a simple method to accommodate the excess refrigeration when it is not possible or desirable to remove liquid nitrogen product.

SUMMARY OF THE INVENTION

It is a major object of the invention to provide a simple, efficient method to meet the above needs. Basically the method involves adding heat to refrigerated rich liquid, collected in a reservoir in a distillation column. To prevent flooding of the column, the method includes the steps:

a) sensing a rise in rich liquid level to a predetermined level in the reservoir, b) removing rich liquid from the reservoir in response to said sensing, to flow to vaporizer apparatus outside a cold box containing said column, c) adding heat to the removed rich liquid and converting the removed rich liquid into gas, in said vaporizer apparatus, d) returning said gas to the distillation column, e) and utilizing heat from the returned gas in the column to remove excess refrigeration from the rich liquid remaining in the column, thereby stabilizing the column against flooding.

Another object includes provision of a valve to allow liquid $N_2$ flow from the column interior into an external storage tank, and wherein sufficient refrigeration is removed from the system to prevent rich liquid rising in the column.

An added object includes operating the column to remove rich liquid from the column at a level above its normal level and converting that to gas for return to the column. This may be accomplished by several methods. The most straight forward is to sense the level and operate a control valve to transfer some of the rich liquid to a vaporizer, convert it to gas, and return the gas to the column. A simpler method involves creating an overflow tap that permits excess rich liquid to spill over and flow by gravity to a vaporizer and return to the column as vapor.

A yet further object includes combining steps a) and e) above with steps that include allowing rich liquid to leave the reservoir to be sub-cooled and flashed to a lower pressure and lower temperatures, and then heating the flow in vapor state for flow through an expansion turbine, to be cooled, as work is extracted from the turbine.

These and other objects and advantages of the invention, as well as the details of illustrative embodiments, will be more fully understood from the following specification and drawings, in which:

DRAWING DESCRIPTION

DETAILED DESCRIPTION

Figure 1:
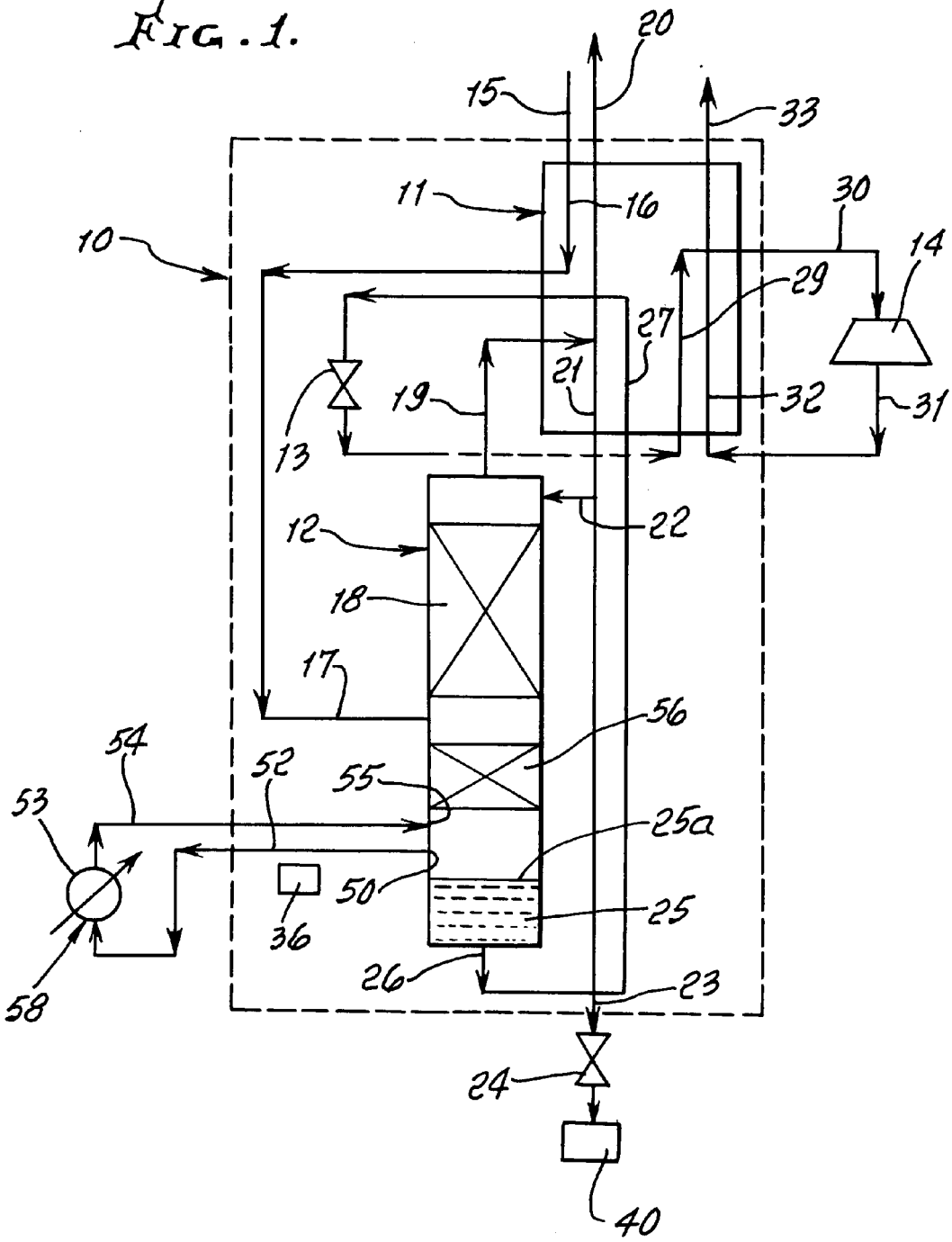
FIG. 1 is a system flow diagram.

The apparatus and process shown in FIG. 1, regarded as preferred, constitutes a typical "waste expansion" cycle nitrogen generator process. (It may be one of any number of processes that have the common problem of producing excess refrigeration).

A typical generator consists of an insulated box 10 (the coldbox) which contains a heat exchanger 11, a distillation column 12 and one or more valves 13 for control. An expansion turbine is either integrated into the coldbox or connected to it. In the typical cycle, compressed air (normally about 6 to 10 bar, with the water and carbon dioxide removed) is supplied at 15 as the feed stock. After cooling at 16 in the multipass heat exchanger to near-saturation temperature, the compressed air is fed at 17 into the distillation column 12, where as it transits the upper distillation section 18 it is purified to nearly pure nitrogen. The nitrogen gas flow leaving the column at 19 is split, with some of it being condensed at 12 in the heat exchanger and returned at 22 to the distillation column as reflux, some of it withdrawn at 23 as liquid nitrogen via valve 24, and the remainder reheated in the multipass heat exchanger and leaving at 20 to form the product gas.

The reflux falling down the column interior collects as "Rich Liquid" (RL) in the reservoir 25 at or near the bottom of the column ("Rich" refers to rich in oxygen relative to air). The rich liquid leaves the reservoir at 26 and is subcooled at 27 in heat exchanger 11 and flashed as at 13 to a lower pressure and lower temperature. The colder liquid is vaporized at 29 in the heat exchanger to produce the refrigeration required to condense the nitrogen gas. After a modest heating, the RL (now vapor) flows at 30 to and through the expansion turbine 14 where it is cooled as work is extracted. The turbine exit fluid at 31, at a pressure slightly above atmospheric is heated at 32 in the multipass heat exchanger 11 to become the waste stream 33. The excess refrigeration (defined as the refrigeration produced in the turbine less the requirement to operate the cycle) accumulates in the reservoir 25 as rich liquid.

A liquid level control 36 senses the rise in the top level 25*a* of 25 RL and opens the liquid nitrogen product valve 24 to remove liquid to the storage tank 40. If the storage tank is full, then no liquid can be removed at 23 and the liquid level in the RL reservoir will rise, flooding the column and preventing the purification process.

An important aspect of the present invention relates to a method of adding heat in the rich liquid reservoir to prevent the column from flooding. A tap is provided on the reservoir at a column wall location 50, at a point higher than the normal liquid level height. As the rich liquid level rises it reaches this tap and spills over into a downward pipe 52 extending to the outside of the coldbox, where it enters a vaporizer 53 converting the rich liquid into a gas. The returning vapor re-enters the coldbox at 54 and is connected to the column interior at a point 55 above the removal tap 50 level. The vapor so generated goes up the column through the lower distillation section 56. The heat added in the external vaporizer removes the excess refrigeration and stabilizes the plant. The external vaporizer can be of any type, but the most likely is an ambient air vaporizer, or a unit connecting with the plant's cooling water system. Heat input appears at 58.

Adding heat to the column in this fashion can produce a secondary benefit. The lower distillation section 56 is optional, but if employed can enhance the plant yield (nitrogen product per unit of compressed air). A modest section can improve the yield several is percent when liquid nitrogen is no longer being withdrawn from the generator.

Accordingly, the method includes the following steps:

a) sensing a rise in rich liquid level to a predetermined level in the reservoir, b) removing rich liquid from the reservoir in response to said sensing, to flow to vaporizer apparatus outside a cold box containing said column, c) adding heat to the removed rich liquid and converting the removed rich liquid into gas, in said vaporizer apparatus, d) returning said gas to the distillation column, e) and utilizing heat from the returned gas in the column to remove excess refrigeration from the rich liquid remaining in the column, thereby stabilizing the column against flooding.

Figure 2:
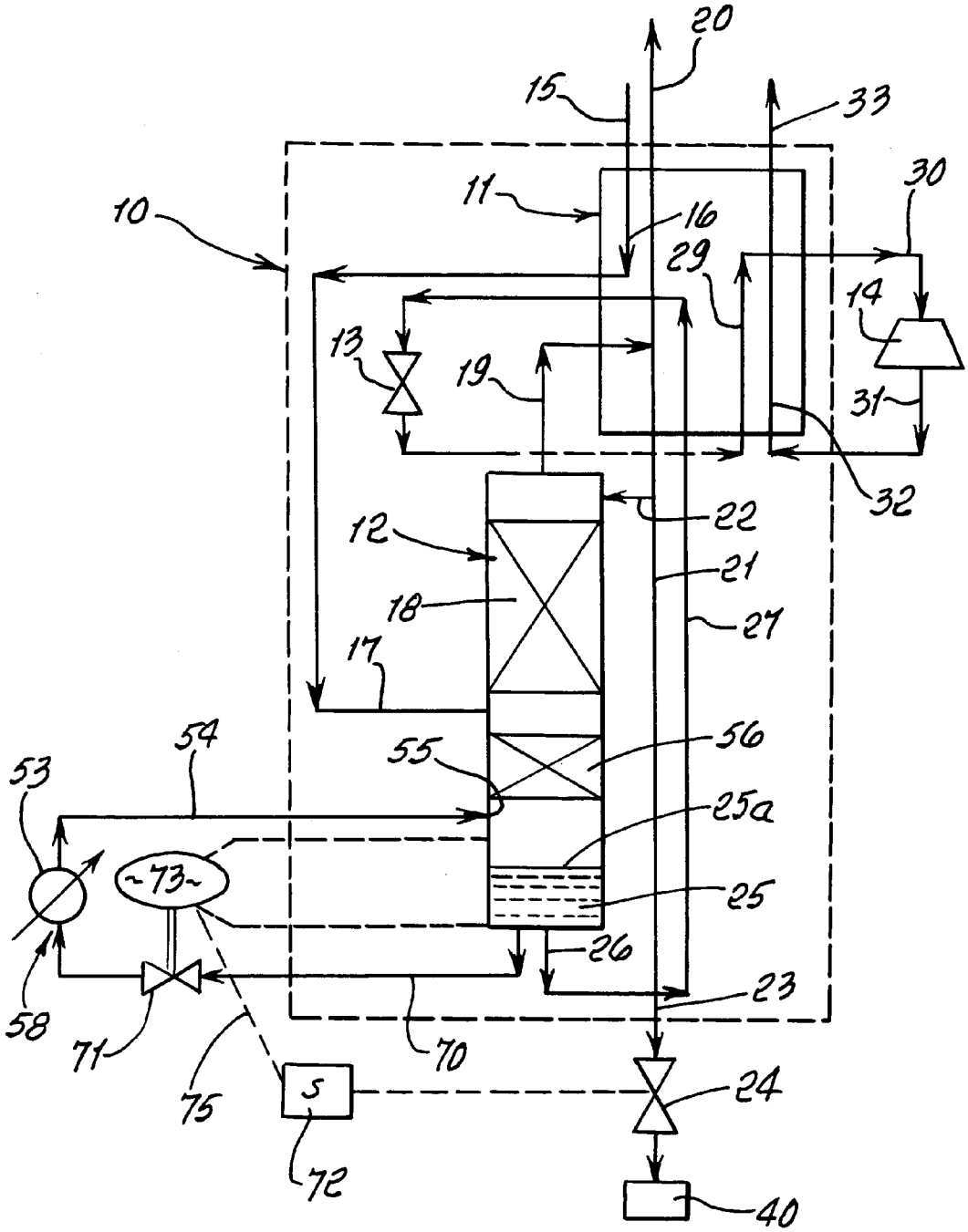
FIG. 2 is another system flow diagram.

FIG. 2 shows a modification, in which a path 70 indicates feed from the bottom of the rich liquid reservoir 25 to the external vaporizer 53 via a control valve 71. When the product tank or tanks are full, a switch 72 is operated to cause valve control 73 to operate for increasing flow of hot gas to the column, via path 54. Switch 72 is connected at 74 to the valve 24 and at 75 to the control 73.

The switch 72 is activated when the liquid nitrogen product tanks are full. This sends a signal 75 to the liquid level control 73 causing the nitrogen withdrawal control valve 74 to close, and redirecting the control signal to the rich liquid control valve 71 (which has been closed prior to switch activation).

We claim:

1. The method of adding heat to refrigerated rich liquid that accumulates in a reservoir in a distillation column, to prevent the column from flooding, that includes the steps a) sensing a rise in rich liquid level to predetermined level in the reservoir, a) removing rich liquid from the reservoir in response to said sensing, to flow to vaporizer apparatus, c) adding heat to the removed rich liquid and converting the removed rich liquid into gas, in said vaporizer apparatus, d) returning said gas to the distillation column, e) utilizing heat from the returned gas in the column to remove excess refrigeration from the rich liquid remaining in the column, thereby stabilizing the column against flooding, f) and including allowing said rich liquid remaining in the column to leave the reservoir to be sub-cooled and flashed to a lower pressure and lower temperature, and then heating the flow in vapor state for flow through an expansion turbine, to be cooled as work is extracted from the turbine.

2. The method of claim 1 wherein the rich liquid consists of oxygen concentrated to a higher level than found in air.

3. The method of claim 1 wherein a valve is provided and controlled to allow rich liquid flow from the column interior into an external vaporizer, and wherein sufficient refrigeration is removed from the rich liquid in the column to prevent it from rising to flood levels.

4. The method of claim 3 wherein said rich liquid consists of oxygen concentrated to a higher than found in air.

5. The method of adding heat to refrigerated rich liquid that accumulates in a reservoir in a distillation column, to prevent the column from flooding, that includes the steps a) sensing a rise in rich liquid level to predetermined level in the reservoir, b) removing rich liquid from the reservoir in response to said sensing, to flow to vaporizer apparatus, c) adding heat to the removed rich liquid and converting the removed rich liquid into gas, in said vaporizer apparatus, d) returning said gas to the distillation column, e) utilizing heat from the returned gas in the column to remove excess refrigeration from the rich liquid remaining in the column, thereby stabilizing the column against flooding, f) including providing a multi-pass heat exchanger through which flow exiting the top of the column is supplied and split, some of the flow exiting the exchanger as $N_2$ gas, and some of the flow exiting the exchanger as $N_2$ liquid.

6. The method of claim 5 including allowing said rich liquid remaining in the column to leave the reservoir to be sub-cooled and flashed to a lower pressure and lower temperature, and then heating the flow in vapor state for flow through an expansion turbine, to be cooled as work is extracted from the turbine.

7. The method of claim 1 including providing upper and lower distillation sections in the column, the point of entry of gas returning to the column being at or below the level of the lower distillation section.

8. The method of claim 5 including a valve controlling $N_2$ flow from the exchanger to a storage tank, and a control for controlling said valve as a function of rich liquid level in the reservoir.

9. In apparatus for adding heat to refrigerated rich liquid that accumulates in a reservoir in a distillation column, to prevent column flooding, that comprises:

a) means for sensing a rise in rich liquid level to predetermined level in the reservoir, b) means for removing rich liquid from the reservoir in response to said sensing, to flow to vaporizer apparatus outside a cold box containing said column, c) means for adding heat to the removed rich liquid and converting the removed rich liquid into gas, in vaporizer apparatus, d) means to return the gas to the distillation column, e) whereby heat from the returned gas in the column is utilized to remove excess refrigeration from the rich liquid in the column, thereby stabilizing the column against flooding, f) there being means for allowing said rich liquid remaining in the column to leave the reservoir to be sub-cooled and flashed to a lower pressure and lower temperature, and for then heating the flow in vapor state for flow through an expansion turbine, to be cooled as work is extracted from the turbine.

10. The method of claim 1 including g) sensing the filled condition of a tank receiving product liquid from the column, for operating a reservoir liquid level control valve via which said removed rich liquid flows to the vaporizer.

11. The method of claim 10 wherein the rich liquid consists of oxygen concentrated to a higher level than found in air.

12. The method of claim 10 wherein sufficient refrigeration is removed by said returned gas from the rich liquid in the column to prevent it from rising to flood levels.

13. The method of claim 12 wherein said rich liquid consists of oxygen concentrated to a higher level than found in air.

14. The method of adding heat to refrigerated rich liquid that accumulates in a reservoir in a distillation column, to prevent the column from flooding, that includes the steps a) sensing a rise in rich liquid level to predetermined level in the reservoir, b) removing rich liquid from the reservoir in response to said sensing, to flow to vaporizer apparatus, c) adding heat to the removed rich liquid and converting the removed rich liquid into gas, in said vaporizer apparatus, e) returning said gas to the distillation column, e) and utilizing heat from the returned gas in the column to remove excess refrigeration from the rich liquid remaining in the column, thereby stabilizing the column against flooding, f) sensing the fitted condition of a tank receiving product liquid from the column, for operating a reservoir liquid level control valve via which said removed rich liquid flows to the vaporizer, g) and including allowing rich liquid remaining in the column to leave the reservoir to be sub-cooled and flashed to a lower pressure and lower temperature, and then heating the flow in vapor state for flow through an expansion turbine, to be cooled as work is extracted from the turbine.

15. The method of claim 10 including providing upper and lower distillation sections in the column, the point of entry of gas returning to the column being at or below the level of the lower distillation section.

16. The method of adding heat to refrigerated rich liquid that accumulates in a reservoir in a distillation column, to prevent the column from flooding, that includes the steps a) sensing a rise in rich liquid level to predetermined level in the reservoir, b) removing rich liquid from the reservoir in response to said sensing, to flow to vaporizer apparatus, c) adding heat to the removed rich liquid and converting the removed rich liquid into gas, in said vaporizer apparatus, d) returning said gas to the distillation column, e) and utilizing heat from the returned gas in the column to remove excess refrigeration from the rich liquid remaining in the column, thereby stabilizing the column against flooding, f) sensing the fitted condition condition of a tank receiving product liquid from the column, for operating a reservoir liquid level control valve via which said removed rich liquid flows to the vaporizer, g) and including providing a multi-pass heat exchanger through which flow exiting the top of the column is supplied and split, some of the flow exiting the exchanger as $N_2$ gas, and some of the flow exiting the exchanger as $N_2$ liquid.

17. The method of claim 16 including a valve controlling $N_2$ flow from the exchanger to a storage tank, and a control for controlling said valve as a function of rich liquid level in the reservoir.

18. Apparatus as defined in claim 9 including means for sensing the filled condition of a tank receiving product liquid from the column, for operating a reservoir liquid level control valve via which said removed rich liquid flows to the vaporizer.

19. In apparatus for adding heat to refrigerated rich liquid that accumulates in a reservoir in a distillation column, to prevent column flooding, that comprises:

a) means for sensing the level of said rich liquid in the reservoir, b) means for removing rich liquid form the reservoir in response to said sensing and in response to accumulation of excess product liquid received from the column into a tank, c) means for adding heat to the removed rich liquid and converting the removed rich liquid into gas, in vaporizer apparatus, d) means to return the gas to the distillation column, e) whereby heat from the returned gas in the column is utilized to remove excess refrigeration from the rich liquid in the column, thereby stabilizing the column against flooding, f) and a multi-pass heat exchanger through which flow exiting the top of the column is supplied and split, some of the flow exiting the exchanger as $N_2$ gas, and some of the flow exiting the exchanger as $N_2$ liquid.

* * * * *

UNITED STATES PATENT AND TRADEMARK OFFICE

CERTIFICATE OF CORRECTION

PATENT NO. : 7,555,918 B1
APPLICATION NO. : 11/438974
DATED : July 7, 2009
INVENTOR(S) : Ross M. Brown and Irina Dean It is certified that error appears in the above-identified patent and that said Letters Patent is hereby corrected as shown below:

Column 5, line 15; "f) sensing the fitted condition of a tank receiving product", should read --f) sensing the filled condition of a tank receiving product--

Column 6, line 1; "f) sensing the fitted condition of a tank receiving", should read --f) sensing the filled condition of a tank receiving--

Signed and Sealed this

Thirteenth Day of July, 2010

David J. Kappos

David J. Kappos
*Director of the United States Patent and Trademark Office*